US005560234A

United States Patent [19]

Ross et al.

[11] Patent Number: 5,560,234

[45] Date of Patent: Oct. 1, 1996

[54] LEVER LOCK

[75] Inventors: Keith J. Ross, 23 Dorset Street, Glen Waverley, Vic 3150; Geoffrey H. Ross, Wheelers Hill; Beverley A. Ross, Noble Park, all of Australia

[73] Assignee: Keith James Ross, Victoria, Australia

[21] Appl. No.: 368,743

[22] Filed: Jan. 4, 1995

Related U.S. Application Data

[63] Continuation of Ser. No. 956,874, filed as PCT/AU91/00253 published as WO91/19873 Dec. 26, 1991, abandoned.

[30] Foreign Application Priority Data

Jun. 19, 1990 [AU] Australia ..... PK0690

[51] Int. Cl.[6] ..... E05B 21/00

[52] U.S. Cl. ..... 70/352; 70/353; 70/355; 70/448

[58] Field of Search ..... 70/349, 352–355, 70/416, 418, 448, 462

[56] References Cited

U.S. PATENT DOCUMENTS

| | | | |
|---|---|---|---|
| 8,071 | 5/1851 | Yale | 70/354 |
| 1,323,753 | 12/1919 | Gogay | 70/448 |
| 1,418,290 | 6/1922 | Deeds | 70/352 |
| 1,518,748 | 12/1924 | Muller | 70/352 |
| 1,594,450 | 8/1926 | Calabrese | 70/352 |
| 1,642,313 | 9/1927 | Smith | 70/448 |
| 2,067,319 | 1/1937 | Haag | 70/75 |
| 2,823,538 | 2/1958 | Fresard | 70/462 |
| 3,402,581 | 9/1968 | Schweizer et al. | 70/355 |
| 3,673,830 | 7/1972 | Billino | 70/352 |
| 3,762,192 | 10/1973 | Errani | 70/352 |
| 3,858,420 | 1/1975 | Sallis et al. | 70/355 X |
| 3,884,058 | 5/1975 | Terry et al. | 70/353 X |
| 3,999,414 | 12/1976 | Leitner | 70/354 X |
| 4,272,974 | 6/1981 | Hennessy | 70/129 |
| 4,587,816 | 5/1986 | Garcia | 70/417 |
| 4,696,174 | 9/1987 | Marks | 70/462 X |
| 4,907,431 | 3/1990 | Mauer | 70/355 |
| 4,958,508 | 9/1990 | Lin | 70/352 |

FOREIGN PATENT DOCUMENTS

| | | | |
|---|---|---|---|
| 15312/83 | 12/1983 | Australia . | |
| 409135 | 4/1935 | Belgium . | |
| 803581 | 2/1951 | Germany . | |
| 130109 | 1/1929 | Switzerland . | |
| 179256 | 4/1922 | United Kingdom . | |
| 1146007 | 3/1969 | United Kingdom . | |
| 2238343 | 5/1991 | United Kingdom | 70/353 |

*Primary Examiner*—Steven N. Meyers
*Assistant Examiner*—Suzanne L. Dino
*Attorney, Agent, or Firm*—Davis, Bujold & Streck, P.A.

[57] ABSTRACT

A bolt-operated, vertical-lift lever lock having a lockcase or lock base and a lock cap, provided with a lever housing attached to at least one of the lockcase or lock base and lock cap and, wherein the lever housing is so constructed that the, or each, lever may slide within the lever housing and be protected against unauthorized lateral or longitudinal forces applied to the bolt.

13 Claims, 5 Drawing Sheets

LEVER LOCK

This is a continuation of application Ser. No. 07/956,874, filed as PCT/AU91/00253 on Jun. 13, 1991, published as WO91/19873 on Dec. 26, 1991, and now abandoned.

FIELD OF THE INVENTION

This invention relates to a lever lock, in particular to a lever lock for use in a wide range of circumstances which has particular utility in sales and in like structures.

BACKGROUND OF THE INVENTION

Lever locks have been developed over several hundred years. When used with corresponding keys, and with an appropriate selection of levers, very many combinations may be achieved.

As these locks have developed, so have techniques to pick or disable the locks. For example, locksmiths (and thieves) have access to picking tools which may be used to move levers one at a time past the gating stump so that the bolt may be withdrawn. Another technique, which is used by locksmiths, is to drill into a lock to remove the gating stump. Yet another technique is to force a flat tool into the lock between the bolt and the socket. The bolt may then be levered back or bent to such an extent that the door may be opened.

If wall safes are considered, locks may be fitted at the right side of a door, its left side or at its bottom or top. It is necessary, therefore, for a locksmith to carry several different types of lock to suit left-handed or right-handed persons.

It is an object of the present invention to make the unauthorised opening of locks significantly more difficult.

It is another object of the invention to provide a lock which may be used at a variety of locations on a door.

It is yet another object of the invention to provide a lock which may be used to lock into the tail bar of the main locking bolt for a bank safe, strong-room or vault.

It is a further object of this invention to provide a lock which may be used domestically, for example, a mortice lock.

BRIEF DESCRIPTION OF THE DRAWINGS

The drawings accompanying this specification relate to a lever lock according to the invention. Thus.

It is to be understood that the embodiments shown are examples only and are not intended to limit the broad scope of the invention.

BRIEF SUMMARY OF THE INVENTION

This invention relates to a lever lock having at least one lever operably connected to a bolt wherein the, or each, lever is protected by an internal lever housing through which the bolt penetrates.

DETAILED DESCRIPTION OF THE INVENTION

This invention provides a bolt-operated, vertical-lift lever lock having a lock exterior casing formed of a lockcase or lock base and a lock cap, characterized by the provision of a lever housing attached to at least one of the lockcase or lock base and lock cap, wherein the lever housing is so constructed that the, or each, lever may slide within the lever housing and be protected against unauthorised lateral or longitudinal forces applied to the bolt. Longitudinal being along the length of the bolt and lateral being transversely across the width and/or height of the bolt.

Preferably the lever housing is attached to both the lock case or lock base and the lock cap.

Preferably the lever housing is adapted to act as a guide for the, or each, lever as it is shifted from a first, inoperative position to a second, operative position and vice versa.

Preferably the lever housing is of box-like construction having two, three or four upstanding walls, wherein two opposing walls of the lever housing act as guides for the lever, or levers.

Conveniently the lever housing is so constructed that the bolt may penetrate through a selected one of two opposing walls of the lever housing whereby the lock may be altered from a right-hand to a left-hand lock or vice versa.

Preferably at least one lever is located on either side of the bolt. More preferably the same number of levers is located on either side of the bolt.

In a preferred embodiment, the lever lock according to the invention is provided with a relocking device wherein the relocking device is adapted to be actuated by tampering with the lock.

Conveniently the relocking device comprises a relocker plate which protects the lock, which relocker plate is capable of actuating a spring-loaded relocker to hinder travel of the bolt.

If it is intended that the lever lock according to the invention should be removable and replaceable in another location, the lever lock may be provided with a retaining key adapted for engagement and disengagement of the lever lock with the element to be secured, such as a door.

Figures 1, 1A, 13:
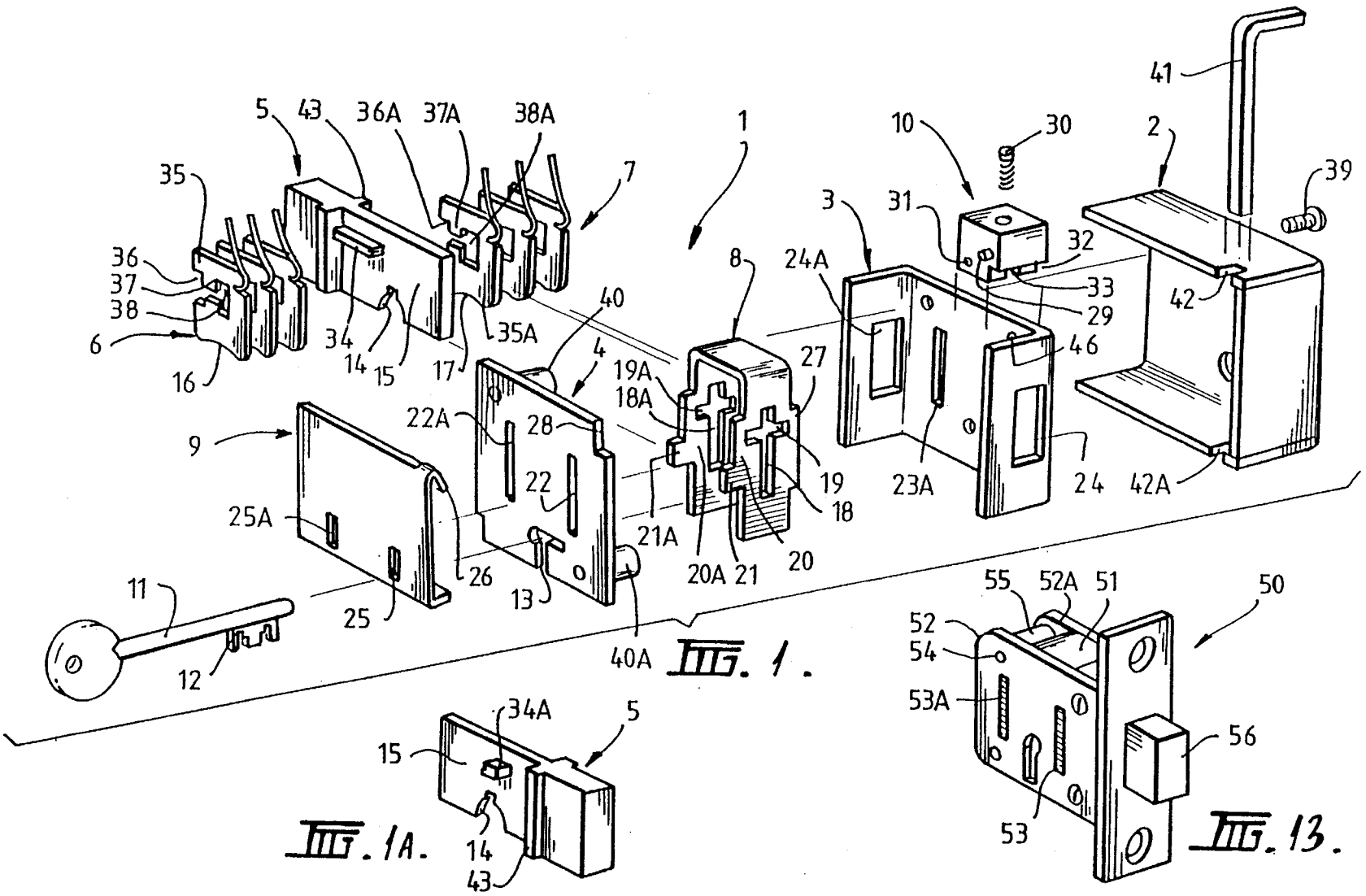
FIG. 1 is an exploded view of the lock.
FIG. 1A is a reverse view of a lockbolt forming part of the lock according to FIG. 1.
FIG. 13 is an isometric view of a mortice lock according to the invention.

In FIG. 1, numeral 1 refers to the lock according to the invention generally. A closed cover 2 is provided for lock 1. Lock case 3 co-operates with lockcap 4, to form a lock exterior casing for housing lockbolt 5. Groups of three vertical lift levers 6 and 7 respectively are provided on corresponding sides of lockbolt 5. The groups of vertical lift levers 6 and 7 and lockbolt 5 are arranged to travel within lever housing 8. A relocker plate 9 located outside lockcap 4 co-operates with deadlock relocker 10 located between lockcase 3 and lockcap 4 and adjacent the tail 15 of lockbolt 5.

Key 11 having a bitted end 12 fits through keyhole 13 in lockcap 4 and co-operates with recess 14 in tail 15 of lockbolt 5. Bitted end 12 further co-operates with the bellies of lever groups 6 and 7, that is, bellies 16 and 17 respectively, to move them within lever housing 8.

Lever housing 8 is generally U-shaped and is provided with cruciform openings 18 and 18A in the respective legs of the U-shape. Cruciform openings 18 and 18A are provided with short horizontal openings 19 and 19A respectively. Each leg is provided with side projections 21 and 21A respectively. On the other side of each leg is provided an opposite projection 27 and 27A respectively (27A is not shown).

Projections 20 and 20A are adapted to fit into vertical slots 22 and 22A in lockcap 4. Further projections 21 and 21A on projections 20 and 20A respectively fit into slots 25 and 25A respectively in relocker plate 9.

Opposing projections 27 and 27A fit into vertical slots 23 and 23A respectively in lockcase 3. (vertical slot 23 is not shown).

Lockbolt 5 may be directed through either bolt openings 24 and 24A in opposite arms of generally U-shaped lockcase 3. Tail 15 of lockbolt 5 travels within lockcase 3 and expanded portion 43 of lockbolt 5 impinges against inner surfaces surrounding lock openings 24 and 24A respectively.

Relocker plate 9 is provided with a turned over portion 26 which is adapted to project through cutaway portion 28 in lockcap 4. Turned over portion 26 impinges on spring-loaded pin 29 mounted in relocker 10.

Figure 5:
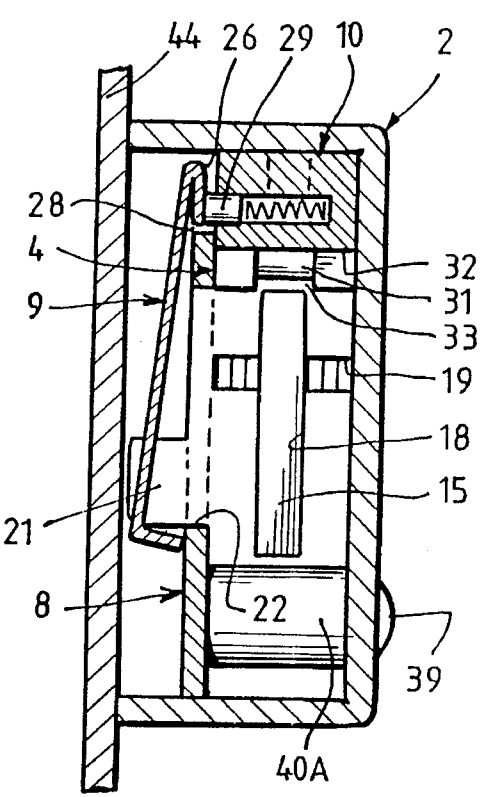
FIG. 5 is a cross-sectional view of the mounted lock of FIG. 3 taken along section line 5—5.
Figure 4:
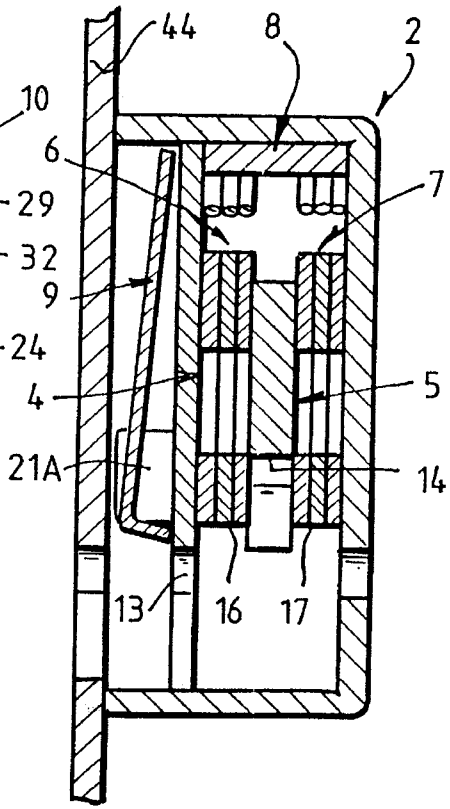
FIG. 4 is a cross-sectional view of the mounted lock of FIG. 3 taken along section line 4—4.
Figure 3:
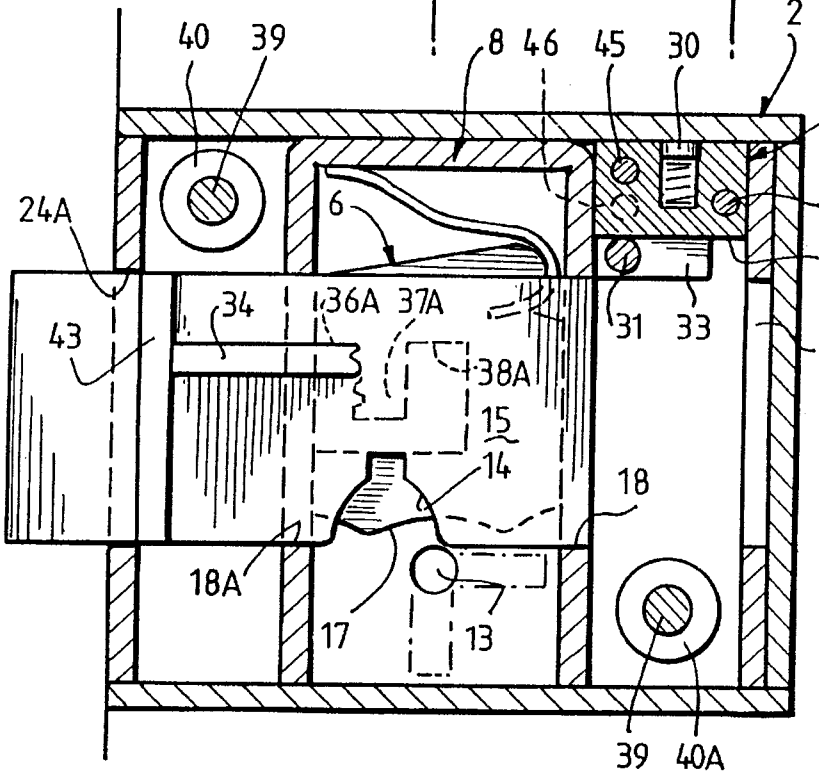
FIG. 3 is a partially cutaway, side sectional view of the lock of FIGS. 1 and 2 shown mounted on a door.

Relocker 10 is generally cube-shaped with a rebate 32 along one edge and a channel 33, perpendicular to rebate 32, cut into a lower face. A removable pin 31 bridges channel 33. Spring-loaded pin 30 is mounted in an upper face of relocker 10 and is arranged to impinge against an inner surface of lockcase 2. As can best be seen in FIG. 5, turned over portion 26 of relocker plate 9 is designed to compress the spring of spring-loaded pin 29 allowing relocker 10 to be forced downwardly by the spring of spring-loaded pin 30. In the lock configuration of FIGS. 1 to 11 inclusive, pin 31 is left in place. Relocker 10 drops behind the tail of lockbolt 15 until it is held by the action of spring-loaded pin 45 projecting the corresponding pin into hole 46 in lockcase 3.

Figure 2:
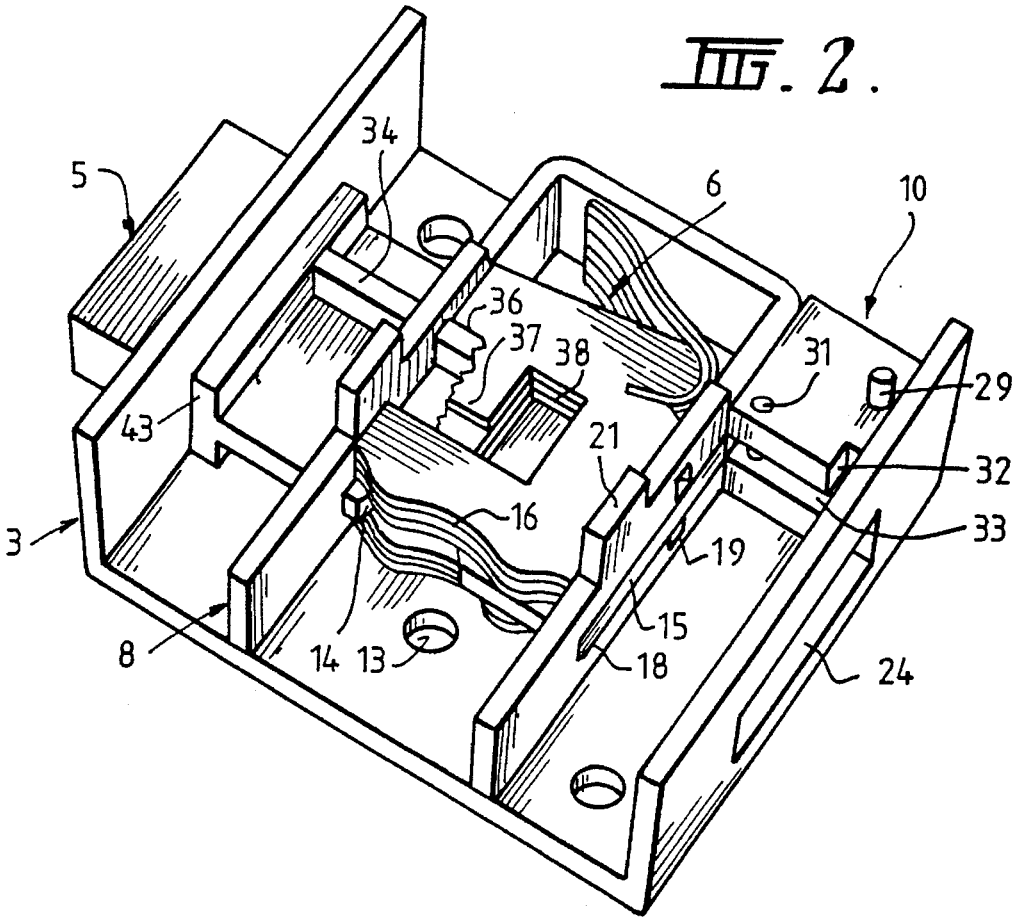
FIG. 2 is an isometric view of a portion of the lock of FIG. 1 shown in the assembled state.
Figure 12:
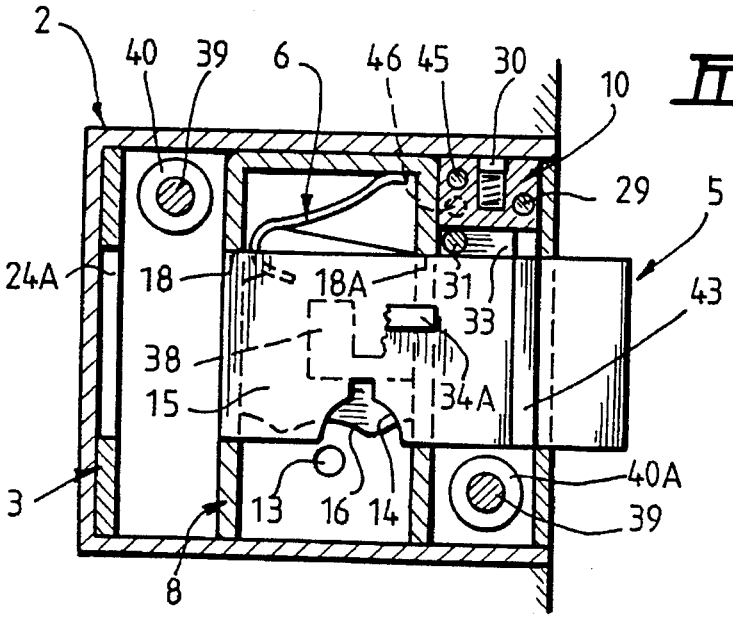
FIG. 12 is a similar view to FIG. 3 but with the lockbolt reversed and the lock mounted at the right side of a door.

As can be seen by reference to FIGS. 2 and 12, when the lockbolt 5 is reversed, pin 31 is removed to allow channel 33 to ride down over the tail of the lockbolt. The function of rebate 32 is to fit over expanded portion 43 of lockbolt 5.

Whether the lockbolt 5 is arranged to travel to the left or to the right, the function of relocker 10 is to travel downwards under the influence of spring-loaded pin 32 to jam either behind the lockbolt 5 or across it to prevent movement. This jamming action is actuated by rotation of relocker plate 9, under pressure from the tip of a drill, for example.

As can best be seen in FIG. 2, numeral 34 refers to a gating stump which penetrates horizontal opening 19A in lever housing 8. The end of the gating stump 34 is shown fitting into depressed portion 36 of gate 35 in lever 6. When the lockbolt 5 is withdrawn by moving the levers 6 and 7 using bitted end 12 of key 11, the end of the gating stump 34 rides over elevated portion 37 of the gates in the lever group. On the other side (see FIG. 1A) of the tail of lockbolt 5 is a shorter gating stump 34A which can ride over the portions corresponding to elevated portions 37 and into the portions corresponding to depressed portion 38. (Portions 36A, 37A and 38A in gate 35A correspond to portions 36, 37 and 38 respectively.) This means that lever group 6 is compressed into lever housing 8 and lever group 7 is slack within lever housing 8. In these configurations of lever groups, the levers are held against undesired motion upwards, downwards or laterally. Elongation of gating stump 34 provides rigidity through interaction with lever housing 8.

The lock is held together by screws 39 (one is shown) which screw into ferrules 40 and 40A on lockcap 4.

Closed cover 2 may be welded or otherwise attached to a door. The body of the lever lock 1 may be retained within the closed cover 2 by means of a retaining key 41 which fits through corresponding holes 42 and 42A in closed cover 2. Numeral 44 indicates the outer skin of a door.

Turning to FIG. 13, numeral 50 indicates a simplified version of the lock according to the invention, a mortice lock. Lever housing 51 supports and guides lever groups (not shown).

Numerals 52 and 52A indicate a lock cap and a lock base respectively.

Projections 53 and 53A on the lever housing 51 protrude through corresponding slots in lock cap 52 and lock base 52A. Screws 54 screw into threaded ferrules 55. Lockbolt 56 is shown in the locking position.

Figure 8:
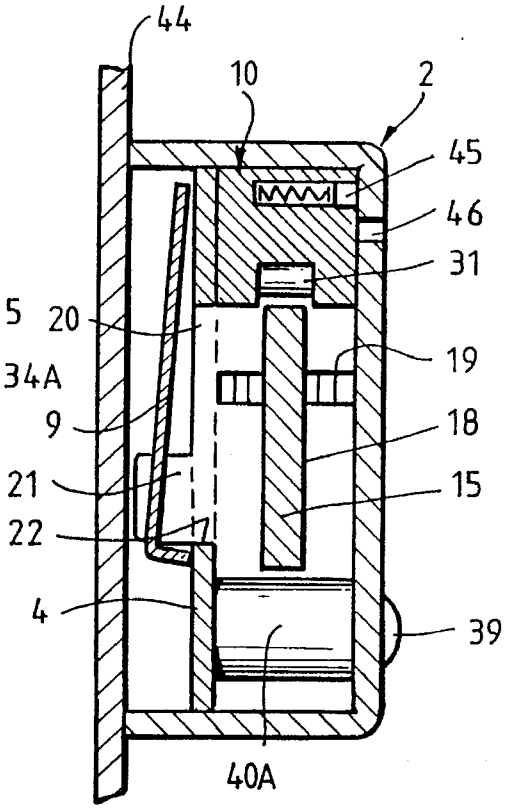
FIG. 8 is a cross-sectional view of the mounted lock of FIG. 6 taken along section line 8—8.
Figure 7:
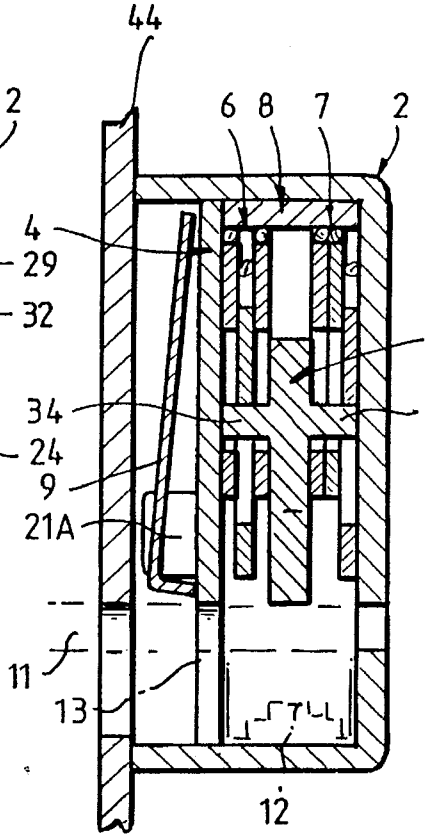
FIG. 7 is a cross-sectional view of the mounted lock of FIG. 6 taken along section line 7—7.
Figure 6:
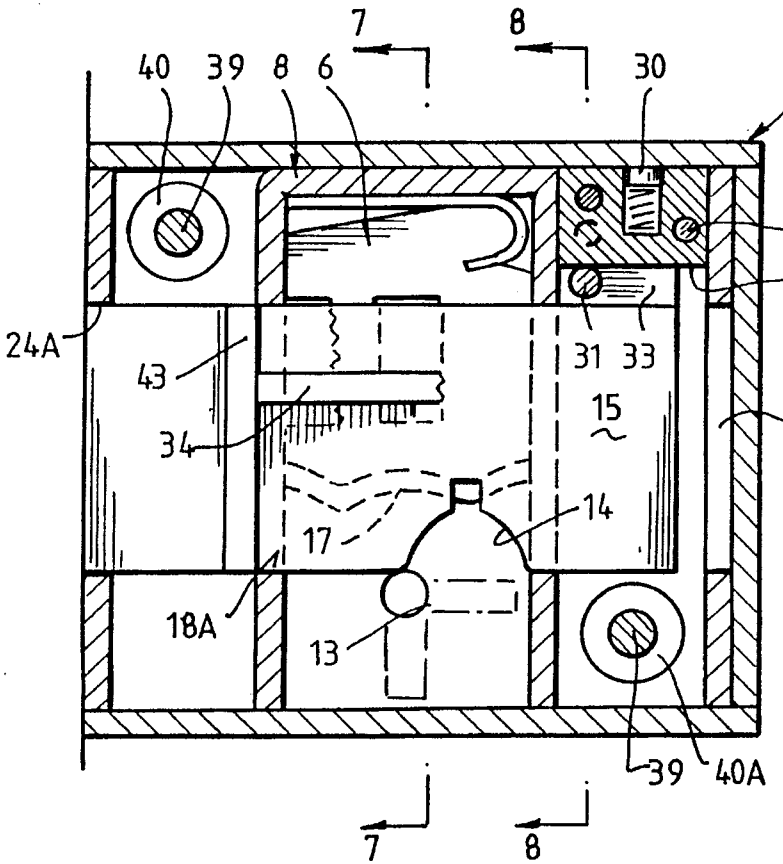
FIG. 6 is a similar view of the lock of FIG. 3 but with the lockbolt withdrawn.
Figure 11:
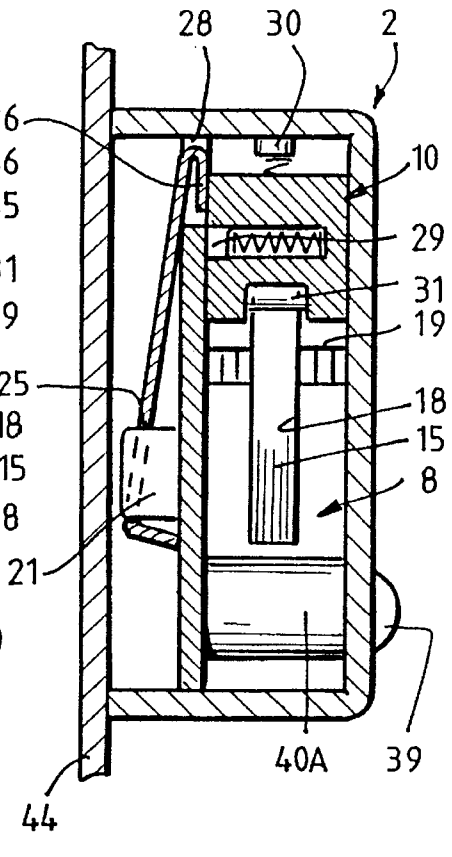
FIG. 11 is a cross-sectional view of the mounted lock of FIG. 9 taken along section line 11—11.
Figure 10:
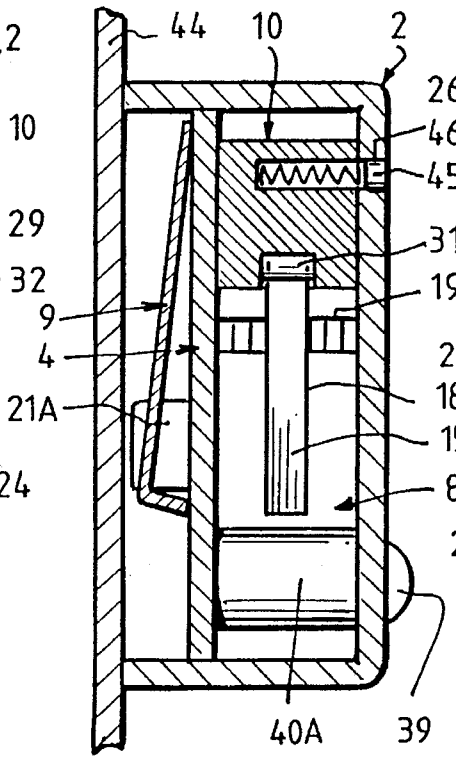
FIG. 10 is a cross-sectional view of the mounted lock of FIG. 9 taken along section line 10—10.
Figure 9:
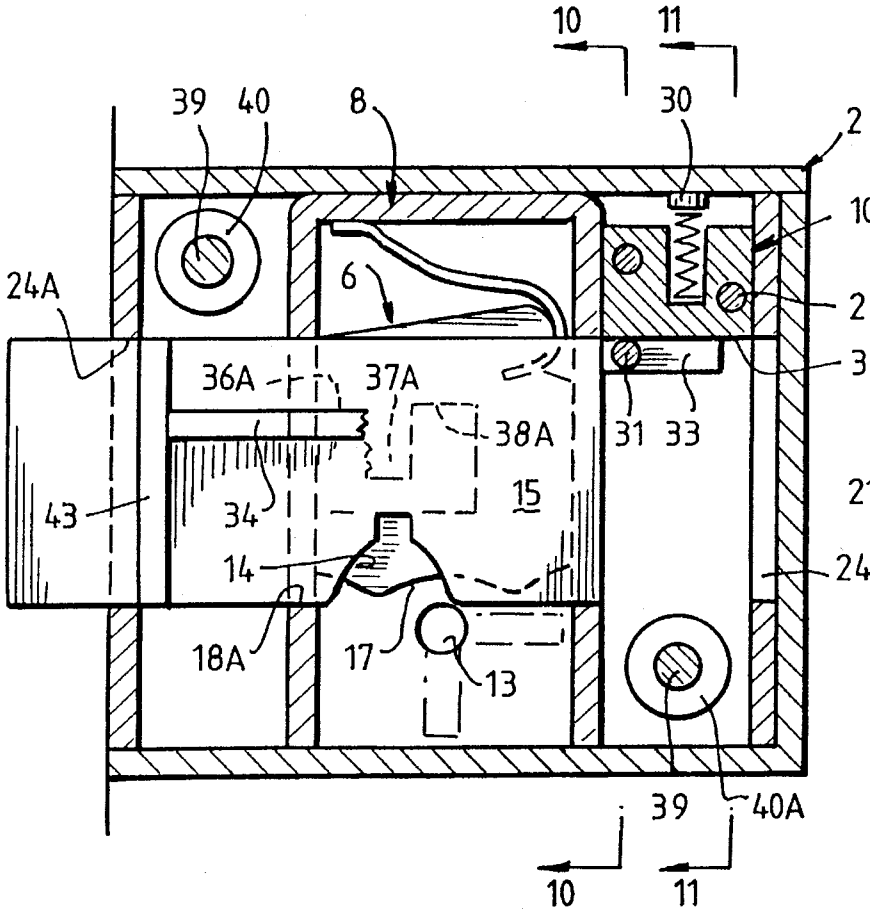
FIG. 9 is a similar view of the lock of FIG. 3 but with a relocker arranged to block travel of the lockbolt.

Turning now to the operation of the embodiment of FIGS. 1 to 12, FIGS. 3 to 5 inclusive show lockbolt 5 in the locked position with relocker 10 in the ready-to-use position. FIGS. 6 to 8 inclusive show the lockbolt 5 withdrawn and relocker 10 in the same position as in FIGS. 3 to 5. In FIGS. 9 to 11, the relocker 10 has operated, projecting down into the path of the tail of lockbolt 5 preventing it from being withdrawn.

Turning to the advantage of elongating gating stump 34 in the direction of movement of the bolt, e.g. longitudinally along the length of the bolt, this elongation provides extra strength to the assembly since the gating stump passes through horizontal openings 19 or 19A in lever housing 8. Thus, in use, with the bolt in the locked position, the gating stump is supported against a lateral thrust from an inserted tool, e.g. up or down or sideways, laterally across the width or height of the bolt.

Bellies 16 and 17 of lever groups 6 and 7 respectively are curved, that is, the distal extremities to left and right are curved gently upwards. With conventional levers, in which the distal extremities are not curved, it is possible to observe wear patterns on the levers, with the consequence that the relative height of the levers may be estimated and the lock picked.

Relocker plate 9 is desirably case-hardened so that, if an attempt is made to drill into the lock, for example, to disable a gating stump, relocker plate 9 engages relocker 10.

When the lever lock according to the invention is assembled and the lockbolt is inserted into a socket in the iamb of a door, an attempt to force the lockbolt sideways is resisted by the lever housing 8 within the body of the lever lock.

The lever lock according to the invention is compatible with electronic security devices such as delay timers.

We claim:

1. A bolt-operated lever lock having at least one lever operably connected to a lockbolt, said bolt-operated lever lock comprising:

an exterior casing fixedly supporting therein a lever housing and having at least one bolt opening accommodating said lockbolt, and said exterior casing being securable to a desired object for facilitating securing of that object to a desired second object;

said lever housing having an aperture extending therethrough and said lockbolt being slidably received within said aperture in a closely mating fashion, thereby permitting said lockbolt to be movable to and fro, relative to said aperture of said lever housing and said at least one bolt opening of said exterior casing, from an extended operative locking position to a retracted inoperative unlocked position, while preventing the lockbolt from being forced in a lateral direction relative to the bolt, thereby allowing said at least one lever to slide within the lever housing and be protected against at least one of unauthorised lateral and longitudinal forces applied to said lockbolt.

2. A lever lock as claimed in claim 1, wherein said lockbolt has opposing front and back sides and at least one lever is provided on the front side of said lockbolt and at least one lever is provided on the back side of the lockbolt.

3. A lever lock as claimed in claim 1, wherein said lever lock further includes a relocking device, fixedly supported within said exterior casing of said lever lock and, upon unauthorized tampering with said lever lock, said relocking device is activated and engages with an end portion of said lockbolt to prevent unauthorized movement of said lockbolt.

4. A bolt-operated, lever lock having an exterior casing at least partially enclosing a lever housing, with at least one lever being slidingly housed in said lever housing and being operably connected to a bolt, wherein said lever housing comprises:

opposing first and second walls, each of said walls having an opening passing therethrough with said openings being in line with each other along an axis extending perpendicular to said walls, said bolt being slidingly received in said openings in a closely mating fashion, wherein the bolt is supported by the sides of said openings such that said bolt is prevented from being forced in at least one of a lateral and a longitudinal direction, relative to said bolt, within said lever housing, whereby said at least one lever may slide within the lever housing and be protected against at least one of an unauthorized lateral and an unauthorized longitudinal force applied to said bolt.

5. A vertical-lift, lever lock, having at least one lever for operatively engaging a lockbolt, comprising:

a lock casing comprising a lockcase and a lock cap, a first aperture passing through one of the lockcase and the lock cap, with the lockbolt extending through the aperture;

a lever housing comprising at least two, substantially parallel sidewalls fixedly mounted in the lock casing between the lockcase and lock cap, a first opening passing through at least one of the sidewalls, in line with the aperture, with the lockbolt extending through the opening;

wherein the at least one lever is slidably mounted within the lever housing, such that the at least one lever is guided by the sidewalls of the lever housing as it is shifted from an operative position in which the at least one lever operatively engages the lockbolt, thereby preventing retraction of the lockbolt from an extended locked position to a retracted unlocked position, to an inoperative position in which the at least one lever is operatively disengaged from the lockbolt, thereby enabling retraction of the lockbolt from the locked position to the unlocked position, such that the lever housing protects the at least one lever from unauthorized forces and unauthorized observation, thereby prohibiting unauthorized picking and forceful unlocking of the lock.

6. A lever lock according to claim 5, wherein the first aperture passes through a left side of one of the lockcase and the lock cap, a second aperture passes through a right side of one of the lockcase and the lock cap, the first opening passes through a left said side wall, and a second opening passes through a right said side wall, in line with the second aperture, whereby the lockbolt may selectively be mounted in a) a left-hand lock configuration in which the lockbolt slidably extends through the first aperture and the first opening, and b) a right-hand lock configuration in which the lockbolt slidably extends through the second aperture and the second opening.

7. A lever lock according to claim 5, wherein there are at least two of said levers, and at least one of said levers is located on a front side of said lockbolt and at least one of said levers is located on a back side of said lockbolt, such that said lockbolt inhibits unauthorized observation and unauthorized physical manipulation of the at least one lever located on the back side of the lockbolt.

8. A lever lock according to claim 7, wherein there is a plurality of said levers and a equal number of the levers are located on the front side of the lockbolt as are located on the back side of the lockbolt.

9. A lever lock according to claim 5, further comprising a relocker releasably mounted in the lock casing, in a position in which the relocker does not engage the lockbolt; and a releasing device for releasing the relocker upon unauthorized tampering with the lock, whereby upon release, the relocker is biased into engagement with the lockbolt, thereby to positively block the lockbolt from being retracted from the locked position into the unlocked position.

10. A lever lock according to claim 9, wherein a pin is slidably received in a bore in the relocker and a spring biases the pin into engagement with a through hole in one of the lock case and the lock cap, thereby releasably mounting the relocker in the casing; and a relocker plate is located on a front side of said casing to protect the casing from unauthorized forces and drilling and, upon application of unauthorized forces or drilling, to engage the pin and move the pin, in opposition to the spring, out of engagement with the recess, thereby to release the relocker and block the lockbolt in the locked position.

11. A lever lock according to claim 5, wherein the sidewalls of the lever housing are connected by a third wall that extends substantially perpendicularly to the sidewalls defining a substantially U-shaped lever housing.

12. A lever housing according to claim 11, wherein the lockcase and the lock cap each have two parallel, elongate slots in an inner surface thereof; and each of the sidewalls have a pair of elongate projections extending outwardly from opposed side edges of the sidewall, with each of the projections being received in a corresponding said slot in a closely mating fashion, thereby to fixedly mount the lever housing in the casing.

13. A lever housing according to claim 5, wherein the lockcase and the lock cap each have two parallel, elongate slots in an inner surface thereof; and each of the sidewalls have a pair of elongate projections extending outwardly from opposed side edges of the sidewall, with each of the projections being received in a corresponding said slot in a closely mating fashion, thereby to fixedly mount the lever housing in the casing.

* * * * *